United States Patent [19]

Bernot

[11] Patent Number: 4,864,201

[45] Date of Patent: Sep. 5, 1989

[54] LIGHT ACTUATED CURTAIN PULLER

[76] Inventor: Ronald J. Bernot, 38348 Fairfield, Sterling Heights, Mich. 48077

[21] Appl. No.: 771,672

[22] Filed: Sep. 3, 1985

[51] Int. Cl.[4] ..... E05F 15/20

[52] U.S. Cl. ..... 318/480; 49/25; 160/5

[58] Field of Search ..... 318/480, 345 D, 345 H; 49/25; 160/5, 1, 2, 7; 250/200, 236, 237 R

[56] References Cited

U.S. PATENT DOCUMENTS

| | | | |
|---|---|---|---|
| 2,149,481 | 3/1939 | Bosch et al. | 160/5 X |
| 3,529,214 | 9/1970 | Corn | 361/173 |
| 3,646,985 | 3/1972 | Klann | 160/5 X |
| 3,675,023 | 7/1972 | Kunke et al. | 49/25 X |
| 4,471,275 | 9/1984 | Comeau | 318/480 X |

FOREIGN PATENT DOCUMENTS

| | | | |
|---|---|---|---|
| 2102492 | 2/1983 | United Kingdom | 49/25 |
| 2146066 | 4/1985 | United Kingdom | 49/25 |

*Primary Examiner*—Bentsu Ro

*Attorney, Agent, or Firm*—Gerald E. McGlynn, Jr.

[57] ABSTRACT

An automatic electro-mechanical device for opening and closing a curtain or drapery in response to changed light striking a photoelectric cell on the device. The device comprises a miniature high torque reversible electric motor and control packaged in a container of substantially the same size as a conventional cord tensioner of curtains or draperies. To close the drapes at sun-down and open the drapes at sun-up automatically without actuation if the lighting changes for short periods of time, the device comprises a dual timer circuit with individual ramping circuits. One timer circuit monitors the sustained presence or absence of light for a predetermined amount of time. The other timer regulates the motor drive run time. A flip flop circuit signals the current state of the curtains or drapes by providing memory of the last directional movement of the motor.

19 Claims, 3 Drawing Sheets

LIGHT ACTUATED CURTAIN PULLER

BACKGROUND OF THE INVENTION

The field of the invention pertains to electric devices to open and close draperies or curtains, and in particular, to devices that automatically control the position of the draperies or curtains in response to light or heat.

A light actuated electric drapery drive is disclosed in U.S. Pat. No. 4,471,275 wherein the circuit provides overload protection in addition to providing opening and closing of the draperies by manual switches or the light sensor. The light sensor actuates the circuit to operate the drive motor upon sufficient lighting level.

U.S. Pat. No. 3,675,023 discloses combined heat and light sensors for mounting atop a building. The combined heat and light sensors are mounted for electromechanically driven movement to follow the sun during the day. In response to the heat and light striking the sensors with changing levels and direction throughout the day, the sensors control the opening and closing of draperies or Venetian blinds progressively about the building as the sun progresses about the building.

Of more general interest is U.S. Pat. No. 3,529,214 which discloses light responsive systems to automatically control street lamps. The systems include means in the circuit to ignore sudden flashes of light so that the street lamps will not be extinguished in response to a sudden and momentary flash of light.

SUMMARY OF THE INVENTION

In response to the need for a simple and very compact electric drive for draperies or curtains that is automatically actuated in response to changed light level, applicant has invented the very compact and unobtrusive curtain puller disclosed below. The curtain puller is meant to replace the conventional spring loaded tensioner which typically includes a freely rotatable pulley for engagement with the loop of drapery cord and means to attach to the floor or wall.

The new light actuated curtain puller externally appears much like the above tensioner with a pulley adjacent the top and spring tensioned means extending from the bottom for attachment to a floor or wall adjacent the draperies or curtains. Atop the new puller is a light sensing means with a cap to control the direction from which light may enter the light sensing means. As with the tensioner the new puller is preferably positioned behind or adjacent the edge of the drapery or curtain near the side of the window. In this location the cap can shield the light sensing means from the interior lighting and permit light to enter from the window and behind the drapery or curtain.

Inside the new puller is a miniature high torque electric motor having the drive shaft attached to the external pulley. In the preferred embodiment the motor is a reversible alternating current motor optically isolated from a direct current control circuit. The direct current control includes means triggered by the light sensing means to cause a first timing circuit to begin a timing cycle. If the first timing cycle is completed a second timing cycle begins with the start of a motor operate signal.

A flip flop circuit retains the current state of the motor and draperies and permits operation of the motor only for a change of the draperies.

Alternatively, optional configurations can use a direct current reversible electric motor and motor drive or a digital decoder can be substituted for the light sensing means to receive and decode control signals passed through the building wiring.

DESCRIPTION OF THE PREFERRED EMBODIMENT

Figure 3:
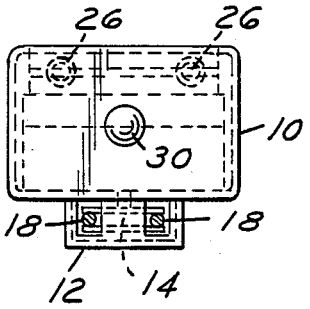
FIG. 3 is a top view of the curtain puller.
Figure 1:
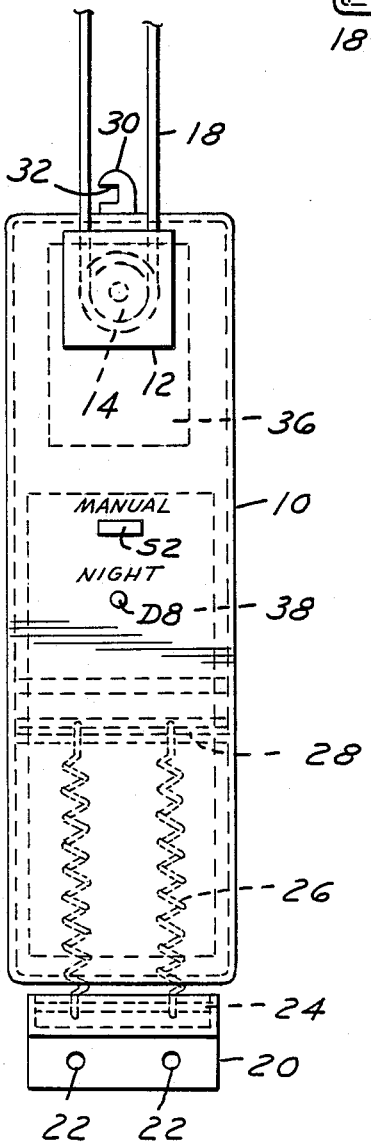
FIG. 1 is a front exterior view of the curtain puller.
Figure 2:
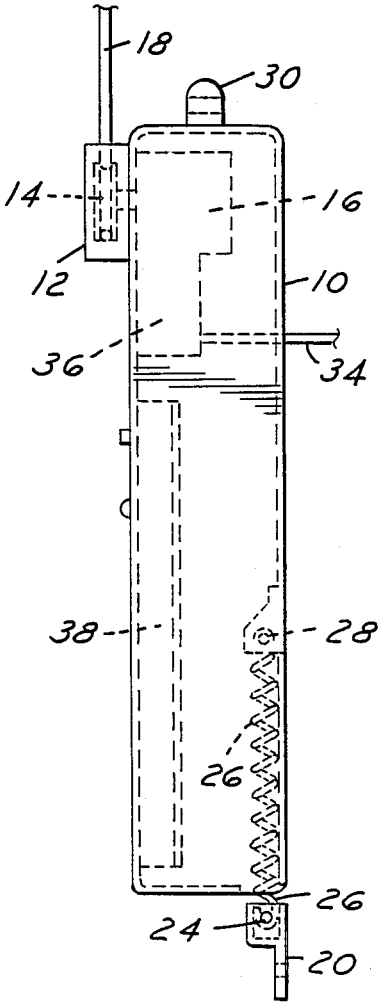
FIG. 2 is a side exterior view of the curtain puller.

Illustrated in FIGS. 1, 2 and 3 is the exterior box or container 10 for the curtain puller. The box 10 may be constructed of metal or plastic halves that merely snap together or are fastened together with mechanical fasteners. Adjacent to the top of the box is a separate cover piece 12 open at the top and affixed to the front of the box 10. Within the cover 12 is a drive pulley 14 mounted on a motor drive shaft extending from a small electric motor 16 within the box 10. The pulley 14 engages the drapery or curtain cord 18 in turn extending downwardly about the pulley 14 and upwardly to the curtain rod (not shown). Thus, the electric motor 16 drives the curtain cord 18 to open or close the curtains or drapes. In other words, the motor 16 moves the object or curtains from an open first position to a closed second position or vice versa.

Below the box is a bracket 20 that may be attached to the wall of a house adjacent a window with mechanical fasteners through the holes 22 in the bracket. Within the bracket 20 is a transverse rod 24 to which a pair of springs 26 are attached at their lower end. The upper ends of the springs 26 are attached to a second transverse rod 28 in turn affixed to the inside of the back of the box 10. The springs 26 provide suitable tensioning for the curtain cord 18.

Atop the box 10 is a small shield 30 which may be manually rotated about a vertical axis. The shield 30 has an opening 32 to permit light to enter therein. Inside the shield is a photocell connected to the internal circuitry of the curtain puller. A 110 volt AC power supply cord as indicated at 34 extends into the box 10 and is attached to a rectifier and motor power circuit indicated at 36. Also inside the box 10 is a printed circuit board 38 to which are attached the electric elements comprising the control circuit for the curtain puller. As shown the box 10 encloses the entire electric control and power supply for the curtain puller. The box 10 is not substantially larger than a conventional spring tensioner for a curtain cord loop.

Figure 4A:
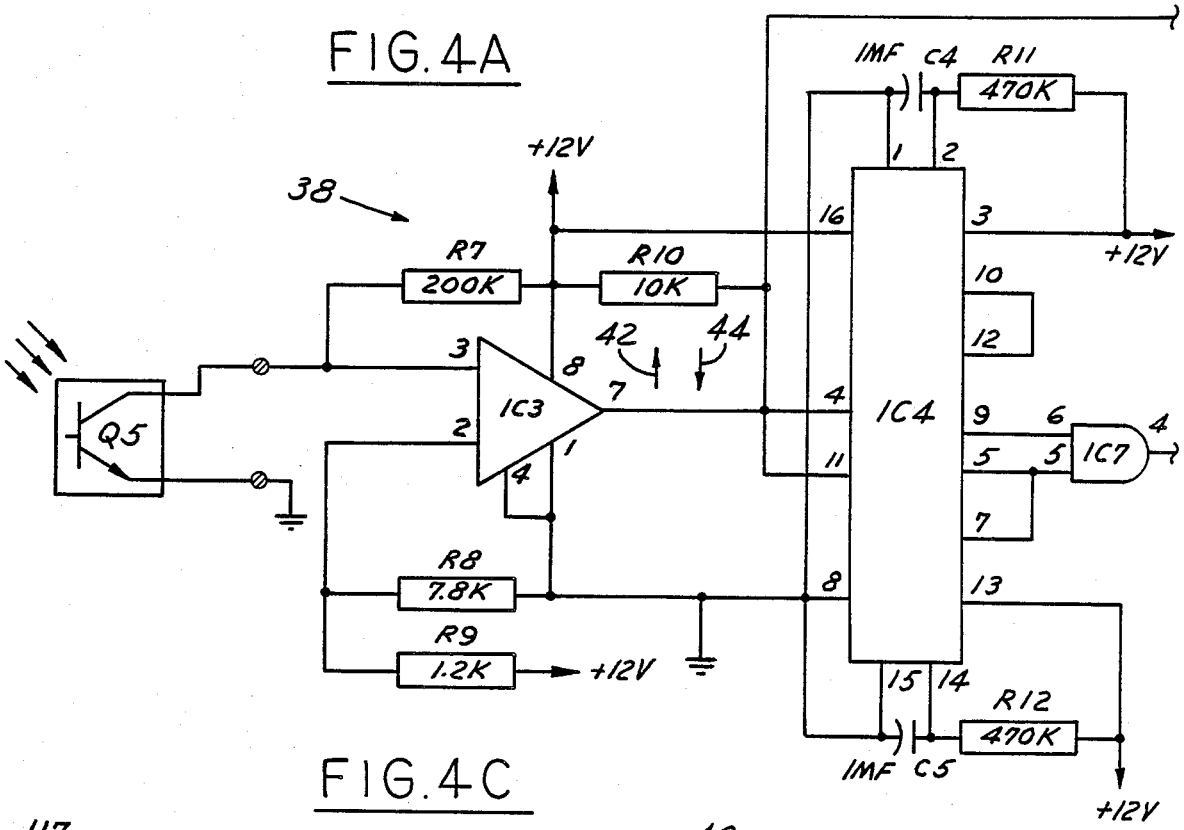
FIG. 4A is an electric schematic for the photoelectric cell circuit.
Figure 4C:
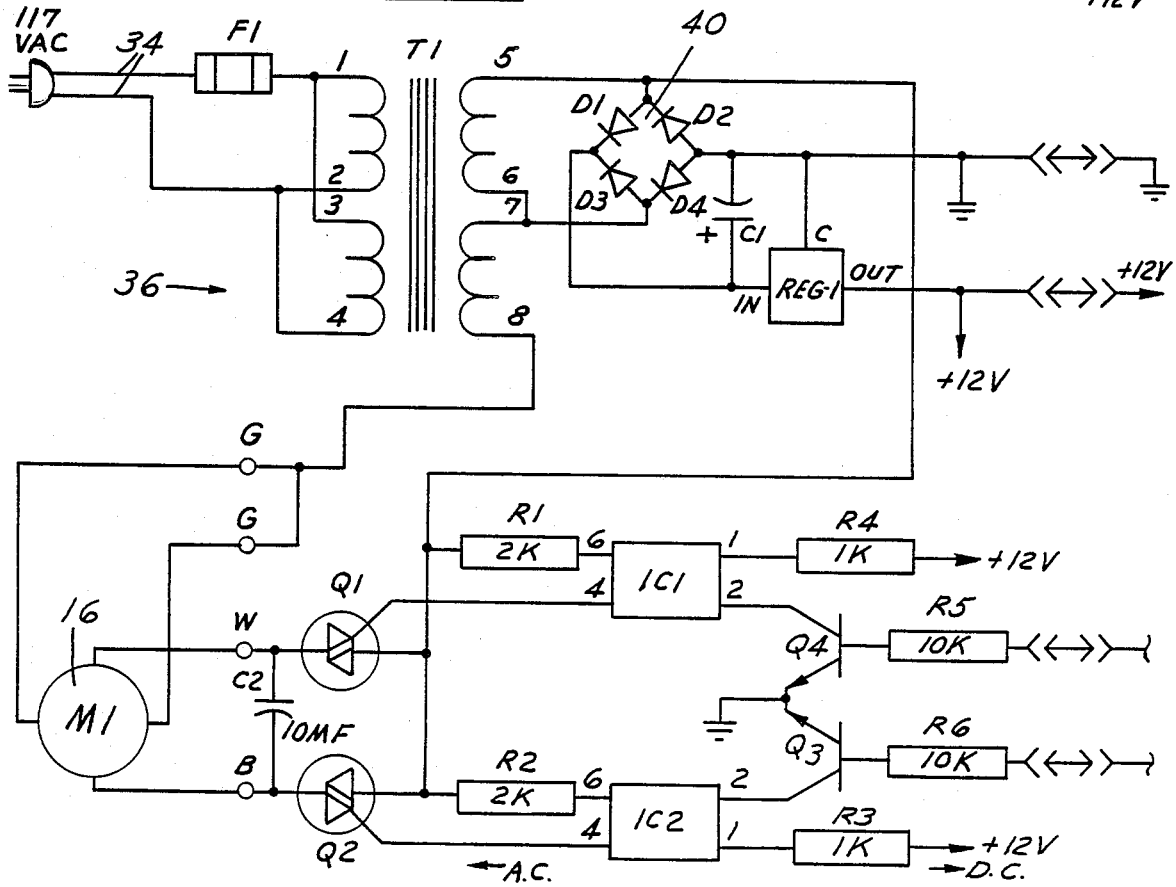
FIG. 4C is an electric schematic for the power supply and motor drive circuit.
Figure 4B:
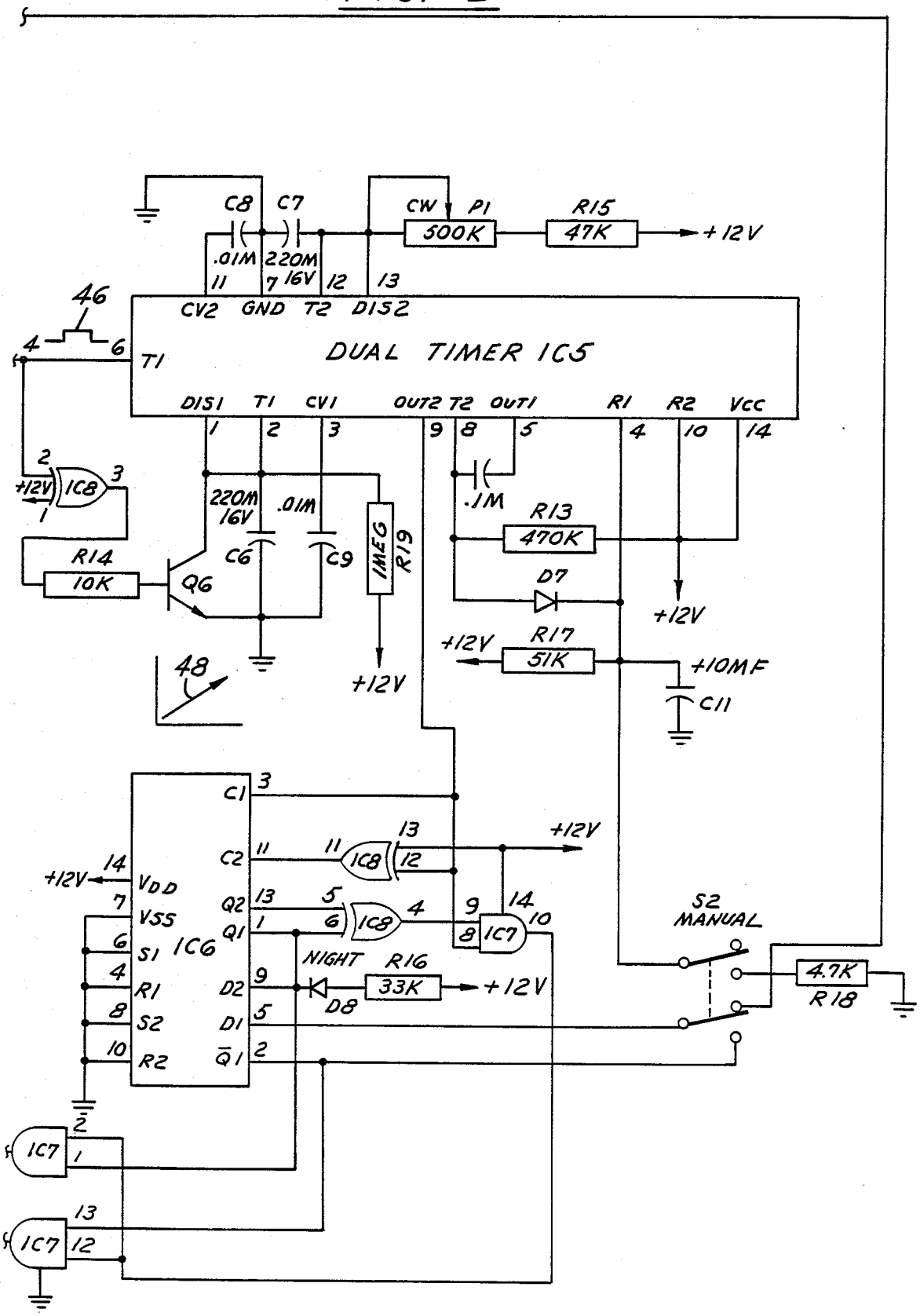
FIG. 4B is an electric schematic for the timing and status circuit.

FIGS. 4A, 4B, and 4C illustrate the control and power circuitry for the curtain puller. With the exception of the 110 volt AC power supply cord 34 and plug for the electrical power to the curtain puller, the control and power circuitry is entirely contained within the box 10. Referring in particular to FIG. 4C, a fuse F1 and transformer T1 in the 110 volt AC supply provide power to a regulator circuit comprising a diode bridge 40 and an integrated circuit regulator REG-1. The regulator circuit provides 12 volts DC power to the control circuit illustrated in FIGS. 4A and 4B and to the isolator circuit including opto-isolators IC1 and IC2 shown in FIG. 4C. The transformer T1 also provides AC power at reduced voltage to the pulley drive motor 16 through the triacs Q1 and Q2. Triacs Q1 and Q2 are in turn triggered by signals respectively from opto-isolators IC1 and IC2. In other words, the transformer and regulator circuit act as a power supply means for supplying power from the 110 AC power source to the control circuit and motor. A suitable motor 16 is a reversible 24 volt 60 cycle AC motor. A reversible DC motor might be substituted for motor 16 with suitable changes in the power supply to provide DC current and solid state switching means in substitution for triacs Q1 and Q2.

The opto-isolators or optical couplers IC1 and IC2 provide electrical isolation between the AC power for the motor 16 and the low voltage substantially DC control signals in the control circuit shown in FIGS. 4A and 4B. The signal through the opto-isolators IC1 and IC2 is provided by a 12 volt DC signal in turn controlled by a pair of transistors Q3 and Q4. The pair of optically isolated connection circuits is between transistor Q4 and triac Q1 and between transistor Q3 and triac Q2. Thus, the control of rotational direction of the motor 16 is determined by a signal from opto-isolator IC1 to triac Q1, or for the other direction, by the signal from opto-isolator IC2 to triac Q2.

The control circuit identified by the reference 38 to a printed circuit board within the box 10 comprises in FIGS. 4A and 4B a photo-electric cell Q5 which is contained within the hooded cover 30 at the top of the box 10. In response to a sufficient increase or decrease in light the photo cell Q5 provides an input to an integrated circuit IC3 which in turn provides an output at pin 7 of a sudden up or down voltage change as indicated by arrows 42 and 44. In other words, the photoelectric cell Q5 is a light sensing means for detecting changes in levels of light, i.e., presence or absence of light in the daytime and nighttime, respectively. The sudden change in voltage up 42 or down 44 is provided as an input to pin 4 of integrated circuit IC4 which in turn massages the signal to provide through integrated circuit IC7 a reset and start signal illustrated by the "one shot" 46 at pin 4 of integrated circuit IC7. The reset and start "one shot" 46 in turn is provided to pin 6 of a dual timer integrated circuit IC5.

A suitable integrated circuit IC4 is a Motorola Monostable Multivibrator MC14538B or equivalent. Integrated circuit IC5 is a National Semiconductor Dual Timer LM556 or equivalent.

The reset and start "one shot" 46 is also provided through integrated circuit IC8 from pin 3 to the base of transistor Q6, which with the associated circuitry and dual timer IC5 provides a ramp function timing signal that increases in voltage continuously from the moment that the "one shot" reset and start signal is received. Typically, this ramp function, as indicated schematically by arrow 48 on the XY plot adjacent transistor Q6, constantly increases the charge on capacitor C6 until a prespecified voltage is reached. Each time the signal from the photocell Q5 passes a threshold of increasing light or decreasing light an up or down voltage change is generated by integrated circuit IC3 and sensed at the base of transistor Q6 to reset the ramp function output 48 by discharging capacitor C6. Typically the ramp function circuit elements connected between transistor Q6 and pins 1, 2 and 3 of integrated circuit IC5 are specified to provide about a 15 minute time period from start or reset until a specified voltage is reached. Thus, short term changes in light level sensed by the photo electric cell Q5 do not result in actuation of the control circuit beyond resetting the ramp function output 48.

Once the specified ramp function voltage is reached, the second timer of integrated circuit IC5 is actuated by the output 1 at pin 5 to T2 pin 8. The second timer includes the circuit elements connected to pins 7, 11, 12 and 13 of integrated circuit IC5. The potentiometer P1 provides adjustable means for setting the length of time the motor 16 operates by setting the specified ramp function maximum voltage for the second timer.

With actuation of the second timer an output 2 signal at pin 9 is provided to pin 3 of integrated circuit IC6 which acts as a flip-flop or latch to determine the current state or position of the motor 16 and thereby determine the current position of the curtain. A suitable integrated circuit IC6 is Motorola Dual Flip-Flop MC14013B or equivalent. The flip-flop integrated circuit IC6 thereby permits or does not permit the motor to operate depending upon the direction of operation of the motor the previous time the motor was actuated to move the curtain. In other words, the flip-flop or latch acts as a latching means for determining the current position of the motor in either of the first and second positions and for actuating the motor to move the object or curtain to the position opposite the current position of the object or curtain. The status of the integrated circuit IC6 can be easily determined by the light emitting diode D8 which is connected to pin 9 of integrated circuit IC6 and illuminated when the curtain is in the closed position. A by-pass or a manual switch S2 is also provided so that the curtain can be conveniently opened or closed as desired during the night or during the day. The manual closure or opening of the curtain is sensed through the connection to pins 2 and 5 of integrated circuit IC6. The output from integrated circuit IC6 pins 1 and 2 respectively provide one-half of the control to the base of transistor Q4 or the base of transistor Q3 thereby determining the direction of rotation. The other half of the control is provided by the output at pin 9 of the dual timer IC5.

Once actuated by the output at pin 9 of integrated circuit IC5 the motor operates for a period of time necessary to move the curtain as set by the exterior circuitry and potentiometer P1 of the second timer of dual timer IC5. The second timer circuit is also actuated by engaging the manual switch S2 to also start the motor running with the second timer. In either case the motor runs for a set period of time sufficient to open or close the curtain. In summary, the flip-flop circuitry only permits the motor to operate when either the signal from integrated circuit IC3 or from the manual switch S2, if thrown, provides for movement of the curtain opposite to that of the previous movement of the curtain.

I claim:

1. An electric drapery puller comprising a motor and motor drive circuit, means to sense a change in light level and a control circuit connected to the light sensing means and the motor drive circuit, first and second timing circuits in the control circuit, said first timing circuit adapted to start and reset in response to change in light level beyond a threshhold level, said second timing circuit adapted to start in response to attainment of an electrical threshhold reached by the first timing circuit simultaneously with a signal in the control circuit to actuate the motor drive circuit, said control circuit adapted to halt the motor in response to attainment of an electrical threshhold reached by the second timing circuit.

2. The drapery puller of claim 1 including latching means in the control circuit to permit movement of the motor only in the rotational direction opposite the previous rotational movement of the motor.

3. The drapery puller of claim 1 including bypass means in the control circuit to simultaneously start the second timing circuit and actuate the motor drive circuit.

4. The drapery puller of claim 1 including latching means in the control circuit to permit movement of the motor only in the rotational direction opposite the previous rotational movement of the motor, and including bypass means in the control circuit to simultaneously start the second timing circuit and to actuate the motor circuit only as permitted by the latching means.

5. An electric drapery puller comprising a motor and motor drive circuit, means to sense a change in light level and a control circuit connected to the light sensing means and the motor drive circuit, first and second timing circuits in the control circuit, said first timing circuit adapted to start and reset in response to change in light level beyond a threshhold level, said second timing circuit adapted to start in response to attainment of an electrical threshhold reached by the first timing circuit and said second timing circuit in response to attainment of an electrical threshhold adapted to signal the control circuit to halt the motor.

6. The drapery puller of claim 5 including latching means in the control circuit to permit movement of the motor in response to attainment of the electrical threshhold reached by the first timing circuit only in a rotational direction opposite the previous rotational movement of the motor.

7. The drapery puller of claim 6 including bypass means in the control circuit to simultaneously start the second timing circuit and the motor as permitted by the latching means.

8. An electric drapery puller comprising a motor and motor drive circuit, means to sense a change in light level and a control connected to the light sensing means and the motor drive circuit, means engageable with a drapery cord and actuateable by the motor, enclosure means attached to the motor frame and attachable to a stationary support, said enclosure means including elastic means in the attachment to the support, first and second timing circuits in the control circuit, said first timing circuit adapted to start and reset in response to change in light level beyond a threshhold level, said second timing circuit adapted to start in response to attainment of an electrical threshhold reached by the first timing circuit and said second timing circuit in response to attainment of an electrical threshhold adapted to signal the control circuit to halt the motor.

9. The drapery puller of claim 8 including latching means in the control circuit to permit movement of the motor in response to attainment of the electrical threshhold reached by the first timing circuit only in a rotational direction opposite the previous rotational movement of the motor.

10. The drapery puller of claim 9 including bypass means in the control circuit to simultaneously start the second timing circuit and the latching means for actuation of the motor as permitted.

11. The drapery puller of claim 8 including bypass means in the control circuit to simultaneously start the second timing circuit and actuate the motor drive circuit.

12. An electronic control apparatus responsive to changes in light levels to move an object between first and second predetermined positions comprising;

light sensing means for sensing changes in light levels, motor means operatively connected to the object and actuable for moving the latter between said positions and control circuit means operatively interconnecting said light sensing means and said motor means for actuating said motor means to move the object between said positions in response to a change in light levels for a predetermined period of time and to deactivate said motor means when the object reaches said first or second positions, said control circuit means including a first or second circuit means connected to said light sensing means for determining a first predetermined time period of a change in light level and a second timing circuit means interconnecting said first timing circuit means and said motor means for determining a second predetermined time period said motor means will actuate to move the object to said first and said second positions.

13. An apparatus as set forth in claim 12 further characterized by said control circuit means including latching means for determining the current position of said motor means in either of said first and second positions and for actuating said motor means to move the object to the position opposite said current position of the object.

14. An apparatus as set forth in claim 13 further characterized by said first timing circuit means including charging means for starting said first predetermined time period in response to a start signal from said sensing means and charging to a predetermined electrical potential and upon reaching said predetermined electrical potential to signal said second timing circuit means to start said second predetermined time period and discharging in response to a reset signal from said sensing means.

15. An apparatus as set forth in claim 14 further characterized by said second timing circuit means including adjustment means for varying the period of time of said second predetermined time period in which said motor means actuates to move the object to said first and said second positions.

16. An apparatus as set forth in claim 15 further characterized by said control circuit means including manual actuation means for manually starting said second timing circuit means and simultaneously actuating said motor means to move the object.

17. An apparatus as set forth in claim 16 further characterized by said sensing means including a photoelectric cell to detect the light levels, and a comparator circuit connected to said photoelectric cell and said first timing circuit means to generate a signal in response to predetermined levels of light detected by said photoelectric cell.

18. An apparatus as set forth in claim 17 including power supply means for supply current from a power source to said motor means and said control circuit means.

19. An apparatus as set forth in claim 18 including enclosure means attached to said motor means and said control circuit means for supporting and attaching said apparatus to a support surface.

* * * * *

UNITED STATES PATENT AND TRADEMARK OFFICE

CERTIFICATE OF CORRECTION

PATENT NO. : 4,864,201

DATED : September 5, 1989

INVENTOR(S) : Ronald J. Bernot

It is certified that error appears in the above-identified patent and that said Letters Patent is hereby corrected as shown below:

Column 6, beginning at end of line 19 and ending at line 20 delete "or second" and insert --timing--.

Signed and Sealed this

Fourteenth Day of August, 1990

*Attest:*

HARRY F. MANBECK, JR.

*Attesting Officer*

*Commissioner of Patents and Trademarks*